US010280726B2

(12) United States Patent
Bestgen

(10) Patent No.: US 10,280,726 B2
(45) **Date of Patent: *May 7, 2019**

(54) SOLUTION MINING USING SUBTERRANEAN DRILLING TECHNIQUES

(71) Applicant: Genesis Alkali Wyoming, LP, Philadelphia, PA (US)

(72) Inventor: Michael Bestgen, Green River, WY (US)

(73) Assignee: GENESIS ALKALI WYOMING, LP, Philadelphia, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/712,667

(22) Filed: Sep. 22, 2017

(65) Prior Publication Data

US 2018/0038213 A1 Feb. 8, 2018
US 2019/0063202 A9 Feb. 28, 2019

Related U.S. Application Data

(63) Continuation of application No. 14/205,711, filed on Mar. 12, 2014, now Pat. No. 9,803,458.

(60) Provisional application No. 61/779,397, filed on Mar. 13, 2013.

(51) Int. Cl.
*E21B 43/28* (2006.01)

(52) U.S. Cl.
CPC ..... *E21B 43/28* (2013.01)

(58) Field of Classification Search
CPC ..... E21B 43/28
See application file for complete search history.

(56) References Cited

U.S. PATENT DOCUMENTS 9,803,458 B2 * 10/2017 Bestgen ..... E21B 43/28

* cited by examiner

*Primary Examiner* — John J Kreck
(74) *Attorney, Agent, or Firm* — Halsey Scarano, L.L.P.

(57) ABSTRACT

A method of solution mining a subterranean mineral ore deposit such as trona ore in which a borehole is drilled from a subterranean mechanically-worked mineral ore mining operation to connect a mineral ore bed to be solution mined, using subterranean drilling apparatus located proximate to the mechanically-worked mineral ore mining operation. The mineral ore bed is isolated from the mechanically-worked mineral ore mining operation by passage of the drilled borehole through an impermeable layer adjacent to the mineral ore bed to be solution mined. The mineral ore bed is then solution-mined using a mining solvent introduced into the mineral ore bed to solubilize the mineral and form a mining solution, and the resulting mining solution is withdrawn from the mineral ore bed.

19 Claims, 1 Drawing Sheet mechanically mined entry
Insoluble Green Shale
1st 250 ft 10" cased cemented
Soluble Trona 3500 psi 3.2 Moh
Insoluble oil shale 1500 to 2500 psi 4 Mohs
Insoluble oil shale 1000 to 2000 psi 1st 250 ft 10" cased cemented

SOLUTION MINING USING SUBTERRANEAN DRILLING TECHNIQUES

CROSS REFERENCE TO RELATED APPLICATION

This application is a continuation of U.S. patent application Ser. No. 14/205,711 filed Mar. 12, 2014, now U.S. Pat. No. 9,803,458, the disclosure of which is incorporated by reference herein in its entirety.

FIELD OF THE INVENTION

The present invention relates to the solution mining of mineral ore deposits such as trona ore and, more particularly, to methods for subterranean drilling initiated from within an underground mechanically-worked mine to solution mine a remote ore deposit using an aqueous mining solvent.

BACKGROUND OF THE INVENTION

Sodium carbonate ($Na_2CO_3$), also called soda ash, is an important, high volume chemical produced in the United States and used in the manufacture of glass, chemicals, soaps and detergents and aluminum, as well as in textile processing, petroleum refining and water treatment, among many other uses.

In the United States, almost all sodium carbonate is obtained from subterranean deposits of naturally-occurring trona ore. The largest known trona ore deposits in the United States are located in the Green River basin in southwestern Wyoming, mostly in Sweetwater County, Wyoming, and are typically about 800 to 3000 feet below ground level.

The subterranean deposits of trona ore consist primarily (80-95 wt. %) of sodium sesquicarbonate ($Na_2CO_3.NaHCO_3.2H_2O$) and contain lesser amounts of sodium chloride (NaCl), sodium sulfate ($Na_2SO_4$), organic matter, and insolubles such as clay and shales.

Trona ore may be recovered from subterranean trona ore deposits, for further processing in surface operations into soda ash or other alkali products, by mechanical mining techniques or by various solution mining methods. The Green River trona ore deposits are presently being commercially mined both by mechanical mining and by solution mining processes.

Mechanical mining, also called dry mining, is carried out underground in the subterranean alkali ore beds by mining crews using complex machinery and includes room-and-pillar and long wall mining methods. Mechanical mining methods are relatively costly due to the upfront cost of sinking mine shafts and continuing need for mining manpower and complex mining machinery. In addition, such mechanical mining methods leave unrecovered a significant fraction of the trona ore in the beds being dry mined, e.g., about 60% unrecovered in room-and-pillar mining and about 30% in longwall mining.

An alternative mining approach developed for recovering minerals from subterranean ore deposits is called solution mining, also sometimes referred to as in situ recovery or in situ leaching. Solution mining can be utilized either as an alternative to or as a supplement to mechanical mining, for the economical recovery of subterranean mineral ore values, such as in the recovery of alkali values from trona ore as soda ash.

In solution mining, the soluble mineral in the underground ore deposit is solubilized with a suitable mining solvent injected via an injection well drilled from the surface down to the underground ore deposit. The resultant mineral-containing mining solution is then withdrawn from the region of the solution-mined ore deposit and pumped to the surface via a withdrawal well for further processing to recover the solubilized mineral values.

Solution mining procedures utilize conventional surface-initiated well drilling technology to drill a borehole from the surface down to the region of the subterranean mineral ore deposit. The drilled well is completed in a conventional manner with casing in the borehole that is sealed in place with cement. Separate wells are normally used for injection of the mining solvent and withdrawal of the mineral-containing mining solution.

Solution mining of trona or other mineral ore deposits is accomplished by injecting water or an aqueous alkaline mining solvent into the ore deposit, via the well. The trona ore deposit may be initially subjected to hydraulic or explosive fracturing to create fissures and openings in the ore to facilitate trona solubilization. The mining solvent is allowed to dissolve or solubilize the mineral ore, with the contact time or residence time being from a few hours to many days. The resulting mining solution (sometimes called mine water or mine liquor) is withdrawn from the region of the ore deposit by pumping the solution to the surface via a withdrawal well. The recovered mining solution is then processed in surface operations to recover the dissolved ore values from the solution, e.g., in the form of soda ash (sodium carbonate) when trona ore is solution mined.

An alkali mining solution from solution mining of a subterranean carbonate mineral ore deposit such as trona typically contains dissolved sodium carbonate and sodium bicarbonate, as well as dissolved organic and inorganic impurities solubilized from the ore deposit. The sodium carbonate values in such alkali solutions are normally recovered as soda ash by various crystallization processes, and the impurities present in the alkali solution are typically removed via a purge stream of crystallizer mother liquor, which is discarded.

Solution mining methods may be employed to recover mineral ore values from virgin (unmined) subterranean ore deposits or may be used for recovering mineral ore values from depleted subterranean ore deposits that have previously been mechanically-worked and abandoned.

Numerous solution mining methods are disclosure in the patent literature for recovery of trona and nahcolite ores, using surface-initiated well drilling techniques to inject a variety of aqueous mining solvents to solubilize the subterranean ore deposit and subsequently recover an alkaline mining solution from the solution-mined ore deposit.

Exemplary solution mining processes for trona are disclosed in U.S. Pat. No. 2,388,009 issued to Pike on Oct. 30, 1945; U.S. Pat. No. 3,050,290 issued to Caldwell et al. (FMC) on Aug. 21, 1962; U.S. Pat. No. 3,119,655 issued to Frint et al. (FMC) on Jan. 28, 1964; U.S. Pat. No. 3,184,287 issued to Gancy (FMC) on May 18, 1965; U.S. Pat. No. 4,264,104 issued to Helvenston et al. (PPG) on Apr. 28, 1981; U.S. Pat. No. 5,043,149 of Frint et al. (FMC) issued Aug. 27, 1991; and U.S. Pat. No. 5,192,164 of Frint et al. (FMC) issued Mar. 9, 1993.

Examples of solution mining procedures applicable to nahcolite ore are described in U.S. Pat. No. 3,779,602 of Beard et al. (Shell Oil) issued Dec. 18, 1973; U.S. Pat. No. 4,815,790 of Rosar et al. (NaTec) issued Mar. 28, 1989; U.S. Pat. No. 6,699,447 of Nielsen et al. (American Soda) issued Mar. 2, 2004; and U.S. Patent Application Publication No. 2009/0200854 A1 of Vinegar (Shell Oil) published Aug. 13, 2009.

An example of a solution mining procedures applicable to salt (sodium chloride) and potash is described in U.S. Pat. No. 2,847,202 issued to Pullen (FMC) on Aug. 12, 1958.

A few solution mining processes describe the use of solution mining techniques to recover alkali values from mined-out sections of trona ore deposits that have earlier been dry-mined, i.e., mechanically-worked.

U.S. Pat. No. 2,625,384 issued to Pike et al. (FMC) on Jan. 13, 1953 describes the solution mining of mined out areas of trona left behind after room-and-pillar dry mining of trona, by introduction of water (the solution mining solvent) and withdrawal of mining solution via underground piping laid in mine passageways in a subterranean dry mining operation. A bulkhead is erected between the solution-mined region and operating dry mining region to prevent the flow of solution mining liquids into the worked section of the dry mining operation.

U.S. Pat. No. 5,690,390 issued to Bithell (FMC) on Nov. 25, 1997 describes a method of solution mining isolated mechanically mined-out areas of soluble trona ore to recover remaining ore reserves, by drilling vertically from the surface then converting the drilling direction to a substantially horizontal well bore at a predetermined distance below the ground level. The horizontal drilling is directionally drilled parallel to and within the trona ore body to form a well bore that connects to the mined-out area. Additional separate wells originating from the surface are drilled for injection of a mining solvent into the mined-out cavity, for connecting the horizontal well bore to an operational mine area, and for pumping recovered solution mining liquor to the surface, all as shown in FIG. 1 of Bithell '390.

Surface processing operations for recovering soda ash from dry-mined trona ore and from alkali mining solutions obtained from trona solution mining are described in U.S. Pat. No. 5,262,134 of Frint et al. (FMC) issued Nov. 16, 1993. The Frint et al. '134 patent describes the recovery of sodium carbonate values from mining liquor obtained from solution mining of subterranean trona ore deposits, via sequential crystallizations of sodium sesquicarbonate and sodium carbonate decahydrate, the latter then being recrystallized as sodium carbonate monohydrate. The Frint '134 patent contains descriptions of various prior art trona ore solution mining techniques and of the "sesquicarbonate" and "monohydrate" soda ash recovery processes applicable to dry-mined trona ore, and those disclosures of U.S. Pat. No. 5,262,134 are hereby incorporated by reference into the present specification.

The present invention provides a method of solution mining subterranean mineral ore beds without the need to drill costly injection or withdrawal wells from the surface. The method of this invention utilizes an existing mechanically-worked subterranean mining operation as the operational base for effecting an underground solution mining operation. In addition, a remote region to be solution-mined is connected via a drilled connective borehole to the operating mechanically-worked mine operation, utilizing safeguards against inadvertent entry of solution mining liquids into the operating mechanically-worked mine.

BRIEF SUMMARY OF THE INVENTION

In accordance with the present invention, a subterranean mineral ore deposit is solution mined in a method comprising connecting (i) a subterranean mechanically-worked mineral ore mining operation and (ii) a mineral ore bed region to be solution mined, with a borehole drilled into the mineral ore bed region to be solution mined using subterranean drilling apparatus located proximate to the mechanically-worked mineral ore mining operation; isolating the mineral ore bed region to be solution mined from the mechanically-worked mineral ore mining operation by passage of the drilled borehole through an impermeable layer adjacent to the mineral ore bed to be solution mined and then into the mineral ore bed region to be solution mined; solution mining the isolated mineral ore bed region using a mining solvent introduced into the mineral ore bed region to be solution mined to solubilize the mineral and form a mining solution; and withdrawing mining solution from the solution-mined mineral ore bed region.

Another embodiment of the present invention is a method of solution mining a subterranean trona ore deposit comprising connecting (i) a subterranean mechanically-worked trona ore mining operation and (ii) a trona ore bed region to be solution mined, with a borehole drilled into the trona ore bed region to be solution mined using subterranean drilling apparatus located proximate to the mechanically-worked trona mining operation; isolating the trona ore bed region to be solution mined from the mechanically-worked trona mining operation by passage of the drilled borehole through an impermeable shale layer adjacent to the trona ore bed to be solution mined and then into the trona ore bed region to be solution mined, the borehole segment through the impermeable shale layer serving as a barrier between the trona bed region to be solution mined and the mechanically-worked trona mining operation; solution mining the isolated trona ore bed region using an aqueous alkaline mining solvent introduced into the trona ore bed region to be solution mined to solubilize soluble components of the trona ore and form an alkaline mining solution; and withdrawing aqueous alkaline mining solution from the solution-mined trona ore bed region.

DETAILED DESCRIPTION OF THE INVENTION

Overview of Invention

Figure 1:
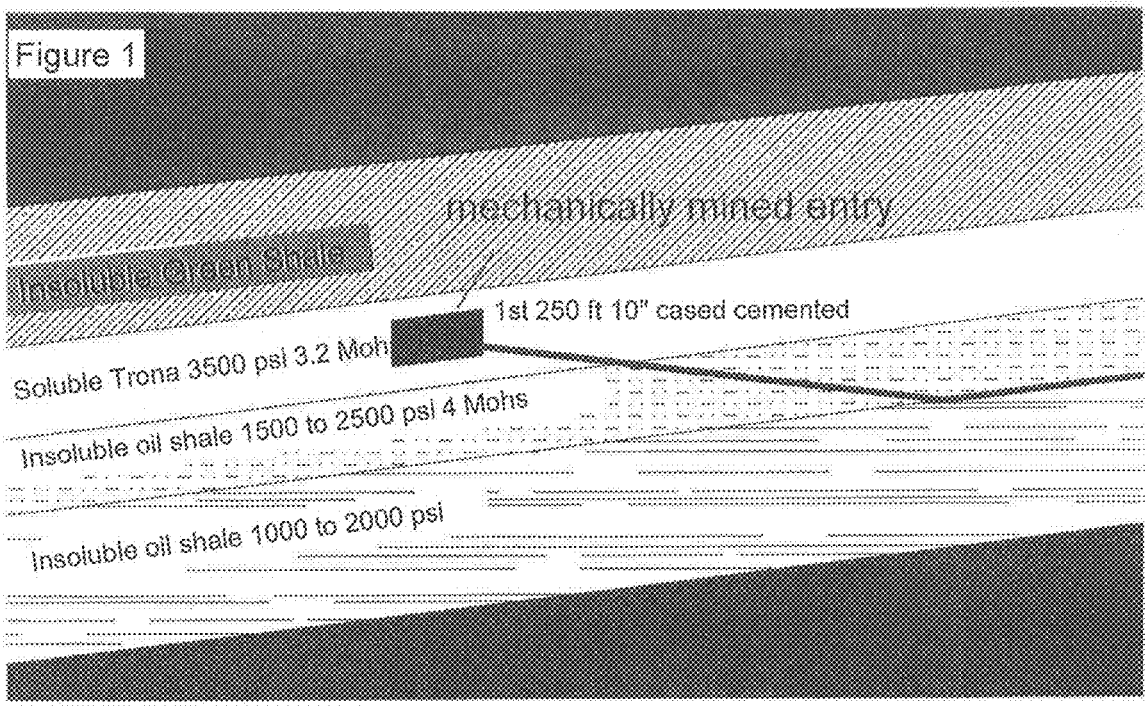
FIG. 1 is a schematic drawing of the solution mining method of this invention applied to recovery of trona ore, showing a side cross-section that depicts a drilled borehole extending from a chamber in a mechanically-mined trona operation into a trona deposit face and then into an underlying shale layer.

The method of the present invention is a technique for carrying out solution mining of a subterranean mineral ore deposit in which the drilling to connect the region of the ore deposit to be solution mined is accomplished entirely underground. The invention utilizes a subterranean mechanical-mining operation as the underground site of the solution mining drilling platform, with the drilled borehole connecting a mineral ore bed region to be solution mined with the mechanically-worked mineral ore mining operation.

In order to insulate the mechanically-worked mineral ore mining operation from accidental or inadvertent incursions of solution mining liquor, the drilled borehole connecting the solution mined ore bed region to be solution mined with the mechanically-worked ore mining operation is drilled through an impermeable or impervious layer adjacent to the mineral ore bed, to create an isolating barrier that cannot be solubilized by the mining solvent or mining solution. This isolating barrier prevents solution in the region of the mineral ore deposit to be solution mined from travelling or migrating back to the drilling initiation point (other than through the drilled borehole or boreholes) by solubilization of the ore in the vicinity of, and along the route of, the boreholes.

Solution mining of the mineral ore bed region to be solution mined is accomplished using a mining solvent introduced into the mineral ore bed region to solubilize soluble components of the mineral and form a mining solution, and the resulting mining solution is withdrawn form the solution-mined region, e.g., withdrawn through the connective drilled borehole.

Several characteristics define the suitability of a mineral ore deposit for recovery by the solution mining method according to this invention:

the subterranean ore deposit to be solution mined must be accessibly near a mineral ore deposit that is being mined via conventional mechanical or dry mining techniques. e.g., room-and-pillar mining or longwall mining the subterranean mineral ore deposit must be capable of being mined via solution mining techniques or via in situ leaching or recovery techniques, using an appropriate mining solvent to solubilize the mineral ore components of interest.

the ore mineral ore deposit must be a bed that is bounded, on at least one boundary (upper or lower), by an adjacent layer that is substantially impermeable or impervious to the mining solvent used in solution mining such ore These and other aspects of the invention are described in more detail below.

Advantages of the Invention

The solution mining method of this invention provides several advantages and benefits, in comparison with conventional solution mining methods described in the prior art.

The drilling of the connective borehole is carried out in situ, proximate to a mechanical mining operation, obviating the need for surface-initiated well drilling and the associated costs. This factor can result in a significant operational cost savings, since mineral ore beds are often located at appreciable depths, e.g., 1000 feet or more below the earth's surface. Since surface-initiated well drilling is unnecessary, the costs for drilling, casing and cementing a well drilled down to the mineral bed depth are avoided. In addition, the disadvantages associated with such surface-initiated well drilling, e.g., disturbance of the surface environment adjacent to the well site, access road development, weather-related operational difficulties or delays, disposal of well drilling tailings or waste, potential contamination of subsurface ground water, etc., are likewise reduced or avoided.

Another significant, unexpected advantage of the solution mining method of this invention is that permitting approvals from governmental regulatory agencies may be greatly simplified or eliminated. Since the method of this invention is carried out within an operating mine, a mining operation that is likely already permitted and approved for recovery of mineral ore values from subterranean beds, the in-ground and in situ solution mining process of this invention may be allowed within the scope of the previously-granted governmental authorizations. This factor represents a significant savings not only in the costs of seeking additional permits and approvals but also in the time typically required for obtaining such authorizations.

Still another advantage of this invention is simplified drilling, since the subterranean in situ initiation of the drilled borehole requires substantially smaller directional changes, as compared to surface-initiated well drilling. Surface-initiated well drilling normally requires a transition change from vertical (downwards) drilling to a substantially horizontal direction (see FIGS. 1 & 2 in U.S. Pat. No. 5,690,390 of Bithell), with its associated constraints on minimum feasible radius (build rates). For example, medium radius well directional changes require about 200 to 1000 feet (build rate=8-30° per 100 feet) to effect a 90° well bore curvature or direction change. Large radius well directional changes, used where long horizontal well bores are called for, require about 1000 to 2500 feet (build rate<8° per 100 feet) for the same right angle change.

The present invention also avoids the drawbacks of the prior art solution mining technique of Pike in U.S. Pat. No. 2,625,384 where a bulkhead is erected between a solution-mined region (in mined-out areas of trona left behind after room-and-pillar dry mining of trona) and operating dry mining region to prevent the flow of solution mining liquor into the worked section of the dry mining operation. Tests of such bulkheads have shown this prior art technique is not a reliable method of blocking solution mining liquor infiltration into the operating dry mining region since such bulkheads are prone to failure after a few months of service.

Ore Deposits Suitable for Solution Mining

The solution mining technique of this invention is suitable for use with a variety of subterranean mineral ores. Suitable mineral ores are those that comprise minerals or mineral components that are solubilizable from the host mineral ore bed that is the target of solution mining, using a suitable mining solvent. The term "solubilizable" as used in this disclosure also is intended to cover minerals that can be solubilized, leached or dissolved from the host mineral ore present in the subterranean bed that is to be solution mined.

The term "subterranean" as used in this disclosure refers to mineral ore deposits and associated recovery operations that are subsurface deposits located underground, as contrasted with surface-type operations such as strip mining which are used to extract or recover mineral ores located relatively close to the earth's surface. The term "solution mining" as used in this disclosure refers to mining operations carried out on subterranean, i.e., underground, mineral ore deposits and is not intended to cover surface-type mineral leaching operations carried out on the surface on exposed minerals or other analogous above-ground mineral processing operations.

The subterranean mineral ore values recovered according to the solution mining method of this invention are normally present in underground deposits as a bed-type formation, the bed typically having lateral dimensions that are significantly greater than its vertical dimension, i.e., thickness. Such beds preferably and typically have a substantially horizontal orientation. For purposes of this disclosure, the terms "substantially horizontal", "essentially horizontal" and "nominally horizontal" shall mean having a bed orientation (in the bed's lateral plane) of less than about 30° (updip or downdip, if not 0° with respect to the earth's surface.

The subterranean mineral ore values recoverable in the solution mining method of this invention may be present as a single bed or multiple beds of the mineral ore deposit. A single bed suitable for ore recovery in the solution mining method of this invention is normally bounded by at least one impermeable layer. The mineral ore deposit may comprise multiple beds, containing the same ore or even containing ores of differing identities (e.g., trona in one bed and nahcolite in a second bed), separated by intervening impermeable layers.

Such bed-type mineral ore formations may be relatively thin, e.g., less than about 4 feet in thickness and not generally susceptible to economic recovery via mechanical mining techniques, or may be more substantial in thickness, e.g., more than about 4 feet in thickness. Thick mineral ore beds are preferred for recovery via the solution mining method of this invention, such beds having a thickness of at least about 4 feet and preferably at least about 8 feet in thickness.

Suitable mining solvents for solubilizing the mineral ores of this invention comprise aqueous mining solvents. Such aqueous mining solvents may be water, aqueous alkaline mining solvents, or aqueous acid mining solvents. The mining solvents are further characterized, for purposes of the present invention, by being substantially unsaturated with respect to the soluble component(s) in the mineral ore sought to be recovered via solution mining. These and other characteristics of aqueous mining solvents suitable for use in the present invention are discussed in more detail below, under Solution Mining Operations—Mining Solvent Characteristics.

The solution mining technique of this invention is particularly well suited for the recovery of subterranean alkali ore deposits such as trona ore and nahcolite ore that are conventionally mined via underground mechanical mining operations. The method of this invention is also suitable for use in recovering other types of mineral ores that are recovered or recoverable via mechanical mining operations and such mineral ores are also described below.

The target mineral ore deposit to be solution mined according to the method of this invention may be a region of a mineral ore deposit that (i) has never been exploited by mining, i.e., a virgin ore deposit, (ii) has previously been mechanically-mined but has since been abandoned and is remote from the currently-operated dry mining region; or (iii) has previously been solution mined, e.g., via surface-drilled conventional injection and withdrawal wells. The target mineral ore deposit to be solution mined according to this invention must be located accessibly near the initiation point of the subterranean drilling, such that a connection via subterranean drilling of a connective bore hole may be effected. The separation distance between these two points (drilling initiation location and the location of the mineral ore deposit to be solution mined) may be very short, e.g., a few dozens or hundreds of feet, or very large, e.g., several thousands of feet.

The mineral ore values recoverable in the solution mining method of this invention are further characterized by being in a deposit formation such that an adjacent layer, above or below the mineral ore bed or both, is an impermeable layer comprising a material that is resistant to the flow of liquid through such layer and to the solubilizing action of the mining solvent used for solution mining the mineral ore bed.

The term "impermeable layer" as used in this disclosure refers to impermeable or impervious rock layers whose component materials are significantly less soluble and, preferably, essentially insoluble in the mining solvent that is used to solubilize the targeted mineral in the mineral ore bed being solution mined and, further, that are generally regarded as impervious to the flow of liquids, e.g., water, through such a layer. The impermeable layers are typically shale, e.g., oil shale or "green shale," but may comprise other insoluble, impervious rock-like materials, e.g., mudstone, compacted clay, sandstone and limestone, that are not susceptible to being dissolved or leached or otherwise solubilized by the mining solvent.

Mineral Ores

Specific mineral ore deposits that are suitable for solution mining via the method of this invention include the following, now described in more detail. The subterranean mineral ore deposit may be a carbonate-type mineral ore such as trona, wegscheiderite, nahcolite, including mixtures of these minerals. The subterranean mineral ore deposit utilized in this invention may also be a mineral ore that contains potash, halite, uranium, copper or gold. These mineral ores are discussed in more detail below.

Trona

Trona ore is a naturally-occurring subterranean alkali ore that contains sodium sesquicarbonate ($Na_2CO_3.NaHCO_3.2H_2O$) as a primary component. In the United States, all of the commercially-exploited trona ore deposits are located in the Green River basin in southwestern Wyoming, mostly in Sweetwater County, Wyoming.

These trona ore deposits are in a formation containing numerous subterranean beds located about 500 to 3000 feet below ground level. These trona ore beds range in thickness from a few inches to over 20 feet thick.

The main trona ore bed in the Green River basin trona deposits that is currently being extensively mined via dry mining operations is Bed 17. Trona Bed 17 is about 12 feet in thickness, being substantially horizontal in orientation, and covers about 100 square miles. This trona bed is located about 1500 feet below ground level and is sandwiched between adjacent layers, above and beneath, of water-impermeable shale.

Other trona ore beds in the Green River basin formation are generally of lesser thickness but are numerous: there are about 25 separate beds of trona ore having a thickness of at least four feet, lying at depths between about 500 and about 3000 feet below the surface and separated by intervening layers or strata of shale. Although these thin beds may not be economical to mine via conventional mechanical mining operations, their trona values are amenable to recovery via solution mining techniques.

The beds are situated in a substantially horizontal orientation and, despite their relative thinness, extend for miles in their horizontal plane (the plane though their lateral dimensions). The beds typically dip deeper in a southerly direction, at a rate of about 20 feet per 1000 feet along the horizontal plane of the bed.

Although trona ore deposits located in the Green River basin consist primarily of sodium sesquicarbonate (e.g., typically 80-95 wt. %), the ore also may contain lesser amounts of sodium chloride (NaCl), sodium sulfate ($Na_2SO_4$), organic matter, and insolubles such as clay and shales. A representative analysis of crude trona ore being mined at Green River, Wyo. is as follows:

| Constituents | Weight Percent |
|---|---|
| sodium sesquicarbonate | 90 |
| sodium chloride (NaCl) | 0.1 |
| sodium sulfate ($Na_2SO_4$) | 0.02 |
| organic matter | 0.3 |
| insolubles (clay and shales) | 9.6 |

Depending on the specific ore bed, the trona ore deposit may also contain amounts of other carbonate-type minerals such as nahcolite, wegscheiderite, shortite, or the like, in addition to the impurities noted above.

The trona ore beds are interspersed between intervening layers of shale or mudstone, typically greater in thickness than the trona beds. These shale and/or mudstone layers are adjacent to the trona beds as either upper or lower boundary layers or both. These shale and mudstone layers, which essentially sandwich many of the trona beds, are substantially insoluble or impermeable with respect to water or aqueous alkali solutions, the latter typically being used as a mining solvent for solution mining of trona in trona mining operations.

Water and aqueous alkali solutions are the trona mining solvents most often proposed for use in the solution mining of trona ore; see, e.g., the U.S. patents mentioned above in the Background section. Aqueous alkali solutions containing substantially less-than-saturated concentrations of $Na_2CO_3$ and $NaHCO_3$ are favored for use as mining solvents to solubilize subterranean trona ore deposits in commercial solution mining operations in use at Green River, Wyo. The aqueous mining solution resulting from solubilization of the sodium sesquicarbonate in the trona contains sodium carbonate and sodium bicarbonate, the latter in smaller amounts.

Nahcolite

Nahcolite is a naturally-occuning subterranean alkali ore that contains sodium bicarbonate ($NaHCO_3$) as its primary constituent. Nahcolite ore is an alkali ore that is usually categorized as a carbonate-type ore. Nahcolite ore deposits may be recovered for their $NaHCO_3$ values as sodium bicarbonate or for production of soda ash ($Na_2CO_3$) by decomposition or neutralization of the bicarbonate into carbonate.

Vast nahcolite ore deposits exist in the Piceance Creek basin in northwestern Colorado. These nahcolite deposits exist in the form of nominally horizontally-oriented subterranean beds that are typically only a few feet thick, e.g., 5 to 20 feet being representative. Although the thickness of the beds is relatively thin, such nahcolite beds can be quite extensive, covering a very large area. The nahcolite ore beds are interspersed with layers of oil shale, and these hydrocarbon-containing shale layers are typically much thicker that the interspersed nahcolite layers. Other minerals may also be present with the nahcolite, e.g., halite (NaCl), wegscheiderite ($3NaHCO_3.Na_2CO_3$) and dawsonite ($NaAl(CO_3)(OH)_2$).

The nahcolite ore may be recovered either by mechanically-worked mining operations or via solution mining techniques, the latter preferably using water or an aqueous alkali solution as the mining solvent. The aqueous mining solution resulting from solubilization of the nahcolite ore with an alkaline mining solvent typically contains both sodium bicarbonate and sodium carbonate.

Potash (Potassium Chloride)

Potash, an evaporite mineral, is another subterranean mineral ore that is suitable for recovery according to the method of this invention. Extensive potash ore deposits are located in the Permian basin in New Mexico, as bedded formations with the primary mineral constituent being sylvite (potassium chloride, KCl) or sylvinite (sylvite mixed with halite, NaCl) with some deposits containing langbeinite (potassium magnesium sulfate, $K_2SO_4.2MgSO_4$).

Subterranean potash ore deposits are typically bedded layers in subterranean ore deposits and are conventionally recovered via mechanical mining techniques, e.g., room and pillar mining. Potash may also be recovered from these subterranean ore deposits via solution mining, e.g., using water or saline water as mining solvents. Solution mining recovery operations have been carried out on potash ore deposits in Michigan, Utah and New Mexico, the latter two operations being conversions from mechanical mining to solution mining for recovery of residual potash values.

Halite

Halite is another mineral ore whose subterranean ore deposits are suitable for recovery according to the method of this invention. Halite, an evaporite mineral, is a naturally-occurring mineral form of salt (sodium chloride, NaCl) and is also called rock salt. Extensive subterranean halite deposits that are currently being commercially mined are located in the Appalachian basin of western New York, in the Michigan basin, and in Ohio and Kansas.

Subterranean halite deposits may be in the form of salt domes or layered beds. Bedded or layered deposits of halite are conventionally recovered via mechanical mining techniques using room and pillar mining. Halite can also be recovered via solution mining in the form of an aqueous salt brine using water as the mining solvent.

Other minerals that may be recovered by the method of this invention include subterranean ore deposits containing uranium, copper or gold.

Uranium, copper and gold mineral deposits may be solubilized using an acid mining solution, e.g., aqueous sulfuric acid, and optionally an oxidizing agent, e.g., hydrogen peroxide. Uranium may alternatively be solubilized using an aqueous alkali mining solvent, e.g., aqueous sodium carbonate, and such alkali mining solvents are preferred for uranium recovery in the U.S. Regardless of whether an acid or alkaline mining (leaching) solvent is employed, the solution mining techniques are essentially same for both types of mining solvents.

Uranium minerals found in subterranean uranium ore deposits are typically uranite (an oxide) or coffinite (a silicate), and these are normally located in permeable sand or sandstone deposits, which are confined above and below by impermeable strata.

Uranium ore deposits are mined using both mechanically-worked operations and solution mining techniques, often called in situ leaching or in situ recovery. Uranium ore deposits in the U.S. are typically solubilized in solution mining operations using an aqueous alkali mining solvent, e.g., aqueous sodium carbonate. Alkali mining solvents are commonly used when other adjacent minerals include acid-solubilizable components such as limestone or gypsum, as is frequently the case with U.S. uranium deposits.

Copper ore deposits may be found near the surface, where the copper ore is typically recovered via open pit mining, or less commonly may be located in subterranean ore deposits. Copper values in subterranean copper ore deposits may be recovered via underground mechanically-worked mines or via solution mining (in situ recovery), usually called stupe leaching, carried out in caved-in sections of formerly mechanically-worked mines.

Copper ore minerals that are readily recoverable via solution mining include malachite and azurite (carbonates), tenorite (an oxide) and chrysocolla (a silicate), but other copper minerals such as cuprite (an oxide) and chalcocite (a sulfide) are recoverable with acid mining solvents that also contain an oxidizing agent.

Gold is usually found in underground deposits as free or native gold encased in other minerals and rock (e.g., iron pyrite) and is typically mined via hard rock mining methods.

Gold may also be found in mineral deposits containing other valuable minerals such as copper or uranium. Gold is not currently recovered commercially via in situ solution mining methods, but experimental solution mining procedures have been piloted for recovery of gold from mineral deposits.

Other mineral ore values besides those specifically mentioned above may also be suitable candidate mineral ore deposits for recovery using the method of the present invention. Such subterranean ores may include carbonate ores, evaporite ores, or mineral ores of other types, with the proviso that such minerals should be capable of being solubilized in an aqueous mining solvent.

Subterranean Drilling Platform

The solution mining method of this invention is carried out from an underground drilling location that is proximate to a subterranean mechanically-worked ore recovery operation. The drilling of the solution mining borehole is initiated from a subterranean location that is proximate to the mechanically-worked mineral ore recovery operation, i.e., adjacent to, accessible from, or within the subterranean mechanically-worked ore recovery operation.

The drilling operation to create the connective borehole is typically carried out from a mine passageway, chamber or ore-depleted panel area within, or accessible from, the mechanically-worked mining operation. The method of this invention is not tied to or dependent on a specific type of mining operation being carried out in the mechanically-worked mining operation. The mechanical or dry mining operation may utilize room-and-pillar mining, continuous mining, longwall mining, or other conventional dry mining techniques carried out for recovery of mineral ore values from an underground mineral ore deposit, or some combination of these.

The subterranean drilling site or platform or location employed for the connective borehole utilized in this invention should be selected so as to be sufficient in size and location to permit unencumbered operation of the drilling rig underground and to allow the drilling operation to be accomplished without interfering with the dry mining operations. In addition, the drilling site should have access to available utilities from the dry mining operation, e.g., electricity, water, air supply and ventilation, drilling waste removal, and the like.

The method of the present invention is particularly well suited for the solution mining recovery of trona ore from subterranean beds. Trona ore deposits in the Green River basin are currently mined primarily using conventional mechanical mining techniques, e.g., room and pillar mining and longwall mining. Such trona dry mining is normally carried out in a single trona ore bed, rather than in multiple beds or in several beds at various depths (as is often the case with commercial coal mining operations recovering coal from subterranean coal deposits). In these mechanically-mined trona operations, large-scale mining equipment such as continuous miners or longwall mining apparatus is brought underground from the surface in a disassembled state, then reassembled, maintained and serviced underground in the trona mine for the duration of its useful operating life.

Particularly with reference to trona dry mining operations, the introduction of a drilling rig and associated equipment into a portion of an operating trona mine designated as the drilling platform site represents no technological challenge. The introduction of drilling equipment, including apparatus for in-ground or in-seam directional drilling, into the passageways of a subterranean mineral mining operation can readily be accomplished under the supervision of mining equipment engineers, mechanics and operators responsible for the oversight and operation of large-scale mining equipment used for below ground mechanical mining operations.

The drilling of boreholes from within the passageways of a subterranean mining operation has long been carried out, e.g., for methane gas control in underground coal mines, so the technology is readily available for drilling essentially horizontal boreholes into the face of a mineral deposit, using a drilling rig located in a passageway of the worked mine. Examples of underground drilling of boreholes in coal seam faces for methane gas venting (e.g., in-seam drilling) are described, e.g., in U.S. Pat. No. 4,303,274 of Thakur (Conoco) issued Dec. 1, 1981 and in U.S. Pat. No. 4,474,409 of Trevita et al. (U.S. Dept. of Interior) issued Oct. 2, 1984.

The application or incorporation of directional drilling techniques, also called smart drilling, to underground-initiated drilling of boreholes in the method of this invention likewise represents no technological challenge to drilling engineers familiar with drilling within a subterranean mechanically-worked mining operation. Such directional drilling techniques are based on the characteristics of the drill bit, bottom hole assembly and associated monitoring equipment employed, rather than whether the drilling is initiated from the earth's surface or from an in-mine subterranean passageway or chamber.

Directional drilling technology, also referred to as a smart drilling system, typically incorporates logging-while-drilling (LWD) and measurement-while-drilling (MWD) instrumentation that are part of the borehole drilling tool system, with real-time data being transmitted back to the drilling operator. MWD uses gyroscopes, magnetometers, accelerometers and/or gamma ray detectors to determine the drilled borehole inclination and azimuth during the actual drilling. The data are then transmitted to the surface through pulses through the mud column (mud pulse) and electromagnetic telemetry. With smart drilling, precisely-controlled directional drilling can be carried out with real-time data providing not only precise drill bit location information but also information about the formation identity and its characteristics, e.g., shale layer detection via natural radioactivity (gamma ray) detectors.

Horizontal directional drilling is preferably carried out with the drilled borehole path being horizontal or updip, for two reasons. First, removal of the boring cutting debris during the drilling operation is facilitated, via flushing and removal of the flushing fluid that is facilitated by gravity-assisted flow. Second, after the updip drilled borehole is completed and solution mining is initiated, withdrawal of solution mining liquor is facilitated by gravity-assisted flow of the mining solution through the borehole from the remote solution-mined formation back to the drilling initiation point, for collection within the worked mine and/or for pumping to the surface for further processing.

The diameter of the borehole drilling should be sufficient to provide effective directional drilling during the drilling process as well as to facilitate the subsequent solution mining operations carried out on the connected remote mineral ore bed. The drilled borehole diameter should be adequate, during the drilling operation, for use of MD and MWD drilling sensor equipment in the directional drilling of the borehole. In addition, the completed borehole should have a bore diameter sufficient for installation of any required pipelines as well as sufficient to accommodate the desired flowrates of mining solvent and mining solution to be transported through the borehole in conjunction with the solution mining operations.

The diameter of the connective drilled borehole typically may range from about 4 inches to about 24 inches, with about 8 to about 16 inches being preferred. The drilled borehole is typically drilled and then reamed to larger bore diameters, with the diameters being successively smaller as the distance from the drilling initiation point increases. The borehole diameter at the point the drilled hole reaches the region to be solution mined is preferably at least about 4 inches to about 10 inches.

It should be readily apparent from the descriptions above of suitable mineral ore beds and the drilling techniques employed that the overall orientation of the drilled borehole connecting the mechanically-worked mineral ore mining operation with the mineral ore bed to be solution mined is substantially horizontal, with respect to the surface, in orientation over its entire length and is preferably relatively linear, aside from the deviation into the impermeable layer. As such, the drilled borehole employed in the solution mining method of this invention avoids radical changes in bore direction, in contrast to the case with vertically drilled well boreholes that must be transitioned from a vertical direction to a horizontal direction. The simplified drilling requirements associated with practice of this invention permit the solution mining of mineral ore bed locations located at great distances, e.g., one mile or more, from the drilling initiation point in the mechanically-worked ore recovery operation.

Impermeable Layer Barrier

A key aspect of the present invention is the creation of an impermeable barrier between the region of the remotely-located mineral ore bed to be solution mined and the region where the mechanically-worked mineral ore mining operation is located. This is accomplished by passage of a portion of the drilled borehole, connecting the mineral ore bed to be solution mined and the mechanically-worked mineral ore operation, though an impermeable layer adjacent to (lying above or below) the mineral ore bed.

The portion of drilled borehole passing through the impermeable layer may be implemented or effected in any of several ways, by (i) a direction or deviation of the drilled borehole from its initiation point in the mineral ore bed being mechanically-mined into an adjacent impermeable layer before the borehole enters the mineral ore bed to be solution mined; (ii) initiation of the drilled borehole in the impermeable layer, at the point where drilling is begun in the mechanically-worked mined ore operation, before the drilled borehole enters the mineral ore bed to be solution mined; or (iii) passage of the drilled borehole through an intervening impermeable layer where the bed to be solution mined is a different mineral ore bed from that being worked in the mechanical mining operation.

In the first embodiment mentioned above, the deviated portion of the drilled borehole into the impermeable layer is accomplished by initiating the drilled borehole in the mineral ore bed at a point proximate to the mechanically-worked mineral ore mining operation, then deviating or directing the borehole out of the mineral ore bed into the adjacent impermeable layer, continuing the drilled borehole in the impermeable layer for a desired or predetermined distance or length, and then deviating or directing the drilled borehole out of the impermeable layer back into the remotely-located mineral ore bed to be solution mined. The drilling into the impermeable layer is preferably started at a point relatively close to the initiation of the drilling, e.g., within about 10 to about 300 feet of the drilling initiation point, so as to facilitate casing and cementing (discussed below) of this portion of the drilled borehole.

The impermeable layer is preferably a shale layer or oil shale layer or mudstone layer or other layered material which is impermeable, e.g., impervious or essentially insoluble with respect to aqueous mining solvents, e.g., water, aqueous alkaline solvents (pH>7), or aqueous acid solvents (pH<7) used in the solution mining of the mineral ore.

The impermeable layer serves as a barrier to prevent inadvertent or unintended solubilization along the proximate length of the drilled borehole, from the action of the mining solvent on mineral ore adjacent to the borehole over a period of time, which could allow mining solution in the region of the solution mining operation to flow back (other than via controlled flow through a drilled borehole) into the region where the mechanically-worked mineral ore mining operation is located.

The length or distance of the passage of the drilled borehole through the impermeable layer should be at least about 2.5 feet, and is preferably at least about 50 feet, more preferably at least about 100 feet, and most preferably at least about 200 feet.

The drilled borehole is desirably cased, typically beginning at or near the initiation point of the drilling and preferably extending into and through at least a portion (preferably the entire portion) of the drilled borehole passing through the impermeable layer. The casing string may extend for at least about 50 feet up to several hundred feet, e.g., 500 to 1000 feet, or more, including the entire length of the drilled borehole up to the point or region where solution mining of the mineral ore deposit is to be effected. The cased borehole is normally also cemented, with cement or a polymeric sealant being pumped into the annular space between the casing string and borehole wall for purposes of sealing and stabilizing the casing string.

The casing-lined portion of the drilled borehole more preferably extends for the entire length of the drilled borehole, up to or into the region of the mineral ore bed to be solution mined. This preferred casing strategy, for the entire length of the drilled borehole, enhances the integrity of the solution flow path between the target mineral ore deposit being solution mined and the initiation point of the drilled borehole in the mechanically-worked mine.

The cased borehole is preferably extended into the target mineral ore bed to be solution mined, e.g., by at least about 25 to 100 feet. The terminal end of the casing in the borehole drilled into the target mineral ore bed is preferably perforated, e.g., for about 50 feet extending back from the end of the casing, to provide multiple flow paths for introduction solution mining solvent or recovery of the solution mining solution, as the case may be.

The region of the mineral ore bed to be solution mined should be located at a distance of at least about 50 feet from the initiation point of drilling proximate to the mechanically-worked mineral ore mining operation, the latter being the initiation point for the drilled borehole connecting the two locations. Preferably, this separation distance is at least about 100 feet, more preferably at least 200 feet and most preferably at least 500 feet. The region of the mineral ore bed to be solution mined should also be separated, at any point within the solution mined region closest to the mechanically-worked mineral ore mining operation, by at least about 100 feet, more preferably at least 200 feet and most preferably at least 500 feet.

A important consideration in the determination of the precise separation distance is an assessment of the risks to personnel in the mechanically-worked mine at the initiation point of the drilled borehole. For example, if the solution withdrawn from the drilled borehole is being drained into a sump having significant capacity or if the solution-mined formation is down-dip from the drilling initiation point, the distance may be short. On the other hand, if a barrier breach risks operator safety in the worked mine, then greater distances are preferable. Other factors affecting the determination of the separation distance include the dip of the formation (up-dip vs. down-dip), the potential chemical driving force (between the mining solvent and resultant mining solution), and the like.

Using directional drilling technology, the connective drilled borehole may connect a mechanically-worked mineral ore mining operation with a region of mineral ore bed to be solution mined that may be separated by a relatively short distance (from as close as 100 feet in separation, as noted above) or located at relatively remote locations, e.g., one or more miles distant. Directionally-drilled boreholes may be targeted to connect a precisely-defined region of a mineral ore bed to be solution mined, regardless of whether the location is only a few hundred feet distant or is remotely located several thousand feet in distance from the initiation point of the drilling.

The connective borehole that is employed in the method of this invention is not limited to a single drilled borehole. Multiple boreholes can be drilled from the same initiation point to connect either multiple mineral ore beds or multiple regions within a single mineral ore bed to be solution mined. Furthermore, such multiple drilled boreholes can be directionally drilled to intersect at points intermediate between the location of the drilling initiation point (proximate to the mechanically-worked mining operation) and the remote bed region or regions to be (or being) solution mined (e.g., see U.S. Pat. No. 7,611,208 issued to Day et al. on Nov. 3, 2009).

The overall or general orientation of the connective drilled borehole is substantially horizontal, as mentioned above, with respect to the earth's surface. A preferred drilling orientation, however, is for the substantially horizontal borehole to be drilled updip from the drilling initiation point, proximate to the mechanically-worked mining operation, to the region of the target mineral ore bed to be solution mined. This preferred updip orientation facilitates withdrawal or recovery of the resultant mining solution, containing the solubilized mineral, via gravity-assisted flow downdip from the region of the solution-mined ore deposit through the connective drilled borehole to the mechanically-worked ore mining operation.

Alternatively, the drilling orientation may be downdip from the drilling initiation point to the region of the target mineral ore bed to be solution mined. In such situations, the solution mining cavity, located downdip from the drilled borehole initiation point, may be pressurized to force the flow of the resulting mining solution out of the cavity.

In a first embodiment of the present invention, described above, the drilled borehole is passed through an adjacent layer of impermeable layer lying adjacent to, above or below, the bed of mineral ore to be solution mined, before the drilling enters the bed region to be solution mined. This deviation or direction of the drilled borehole into the adjacent impermeable layer may occur at any point along the traverse of the drilled borehole between the region of the remotely-located mineral ore bed to be solution mined and the region where the mechanically-worked mineral ore mining operation is located. The preferred location for the entry of the drilled bore bole into the impermeable layer is relatively close to the initiation point of the drilling.

In the second embodiment of the present invention, also described above, the drilled borehole may be initiated directly into the impermeable layer, if the impermeable layer is accessible at the drilling initiation point within the mechanically-worked mine. In this preferred embodiment, the portion of the drilled borehole passing through the impermeable layer is effected by initiating the drilled borehole directly into the impermeable layer at a point proximate to the mechanically-worked mineral ore mining operation, continuing the drilled borehole in the impermeable layer, and then deviating or directing the drilled borehole out of the impermeable layer into the targeted mineral ore bed towards the region of the bed to be solution mined.

These drilling techniques for either directing/deviating the drilled borehole into the impermeable layer or initiating the drilled borehole directly into the impermeable layer are preferably employed for mineral ore beds where the mechanically-worked mineral ore mining operation and solution mining operation are carried out in the same mineral bed, albeit at an appropriate distance separating the two mining operations.

The third embodiment of the present invention, also mentioned above, is applicable to separate mineral ore beds, a first mineral ore bed being subjected to the mechanically-worked mineral ore mining operation and a second mineral bed being subjected to (i.e., the target of) the solution mining operation, the two beds being separated by one or more intervening impermeable layers. In this embodiment, the drilled borehole is initiated at a location proximate to the mechanically-worked mineral ore mining operation, e.g., preferably in a mine passageway or mine chamber in or accessible from the mechanically-worked mineral ore mining operation, and is drilled through the intervening impermeable layer or layers into the second bed that is targeted for solution mining. The initiation point of the drilled borehole may be either in the mineral ore bed being mechanically-worked or directly into the impermeable layer adjacent to the mineral ore bed being mechanically-worked.

The two mineral ore beds, i.e., the first and second beds, may comprise the same mineral ore or may comprise mineral ores that are different in identity. Thus, the two operations may be used to effect recovery of two different mineral ores. For example, a mechanically-worked trona ore mining operation may utilize the drilling techniques of this invention to solution mine a different mineral ore, e.g., nahcolite ore, located in a separate bed above or below the trona bed being subjected to mechanical mining, provided that the two beds are separated by one or more impermeable layers through which the connectively-drilled borehole passes.

Solution Mining Operations

Solvent Injection/Solution Recovery—Optional Surface Wells

The present invention provides a method of solution mining subterranean mineral ore beds without the need to drill injection or withdrawal wells from the surface. The method of this invention utilizes an existing mechanically-worked subterranean mining operation as the operational base for effecting an underground solution mining operation, safely connecting a remote region to be solution-mined to the operating mechanically-worked mine operation via a drilled connective borehole.

The connective drilled borehole may serve as a conduit either for introduction of mining solvent to the region of the solution mining being carried out, or for recovery of mining solution from the region of the solution mining cavity, or both. The drilled borehole itself may serve as the conduit for such fluid introduction or recovery, and in such cases the drilled borehole is preferably cased along its entire length, to the region where the mineral ore deposit is to be solution mined.

In addition or alternatively, the drilled borehole may contain, or have installed within, one or more pipelines, of smaller diameter than that of the drilled borehole, for conducting flow of aqueous mining solvent or for recovery of mining solution containing solubilized mineral values, from the region of the mineral ore bed being solution mined. The flow direction is normally not critical, e.g., flow direction in the inner, smaller diameter pipeline may be in either direction, as noted in the previous sentence. It is also possible that flow direction may be reversed in these conduits during the course of the solution mining operation, to improve the efficiencies of the solution mining operation or for other reasons.

The mining solution that is withdrawn through the connective borehole from the region being solution mined transport is preferably transported to the surface for further processing, to recover the solubilized mineral ore values. The transport of the recovered mining solution that withdrawn from the region being solution mined is preferably accomplished by pipelines that are routed through existing passageways, corridors and mine shafts associated with the mechanically-worked mineral ore operation. Such piping for transport of the recovered mining solution to the surface, via pumping from the underground solution collection point routed through existing mine passageways and shafts or existing utility or piping shafts, avoids the need for a separately drilled withdrawal well.

In an analogous manner, transport of aqueous mining solvent from the surface into the mechanically-worked mineral ore operation, for introduction via the connective borehole into the region of the mineral ore bed being solution-mined, is preferably accomplished by utilizing existing mine shafts and corridors associated with the mechanically-worked mineral ore operation. Piping for introduction of the mining solvent below ground, to the solution mining staging area proximate to the mechanically-worked mineral ore operation, is readily routed through existing mine shafts or piping or utility shafts associated with the subterranean mechanically-worked mineral ore operation.

The method of the present invention may alternatively and optionally be employed with one or more surface-located injection wells being utilized to introduce mining solvent into the region of the mineral ore deposit to be solution mined. In such situations, recovery of the resulting mining solution, formed from dissolution or solubilization of the mineral ore values by the introduced mining solvent, is effected via the subterranean connective drilled borehole, as described above.

The method of the present invention may alternatively and optionally be employed with one or more surface-located withdrawal wells being utilized to recover mining solution formed from dissolution of soluble mineral components in a solution mined region of the mineral ore deposit. In such situations, injection of the aqueous mining solvent used to solubilize the recoverable components, into the region of the mineral ore bed or deposit being solution mined, is accomplished via injection of the mining solvent through the subterranean connective drilled borehole, as described above.

Mining Solvent Characteristics

The mining solvents employed for solution mining in the present invention comprise aqueous mining solvents. The mining solvent may be water or an aqueous alkali solution or an aqueous acid solution, the choice typically depending on the identity of the solubilizable component or components sought to be recovered from the mineral ore deposit to be solution mined. Aqueous alkaline mining solvents are aqueous solvents whose pH value is greater than 7, and aqueous acid mining solvents are aqueous solvents whose pH value is less than 7.

The aqueous mining solvent may be a solution or may be a multiphase aqueous mixture, e.g., an aqueous medium containing solids, as suspended or colloidal solids.

The aqueous mining solvents of this invention, if such solvents already contain solubilized component(s) that are the same as those being targeted for solubilization in the mineral ore deposit, are further characterized by being substantially unsaturated with respect to the soluble component(s) to be recovered from the mineral ore being solution mined.

In the context of the present invention, the terms mining solvent, aqueous mining solvent, aqueous alkaline mining solvent, and aqueous acid mining solvent, and their plurals, should be understood to refer only to those aqueous solvents that are substantially less-than-saturated with respect to the soluble component(s) that are targeted for recovery in the mineral ore deposits(s) being solution mined. Substantially less-than-saturated is intended to refer to solvents that contain less than about 70% of the fully-saturated concentration that would be actually obtained from solubilization of the component(s) in solution mining of the mineral ore at the applicable temperature. Preferably, the aqueous mining solvents contain less than about 50% of the fully-saturated concentration that would theoretically be obtained from solubilization of the component(s) in the mineral ore at the applicable temperature and, more preferably, less than about 30% of the fully-saturated concentration that would theoretically be obtained from solubilization of the component(s) in the mineral ore at the applicable temperature.

It should be recognized that solution mining of a mineral ore, even where the mining solvent residence time in contact with the ore being solution mined is very high, e.g., weeks long, rarely results in the resulting mining solution containing the solubilized ore component at a concentration that is essentially the theoretical saturation concentration that may be achievable in tests carried out in a laboratory environment.

In actual practice, aqueous alkali solutions recovered from solution mining of trona ore or other $NaHCO_3$-containing ore with water or a dilute aqueous alkali mining solvent are normally not completely saturated, as compared to the theoretical equilibrated saturation concentration obtainable under laboratory conditions. At 25° C., a representative aqueous alkali solution obtained from solution mining of trona will typically contain about 13 wt. % $Na_2CO_3$ and about 4.5 wt. % $NaHCO_3$, corresponding to a total alkali content of about 16%. The term total alkali content is discussed below.

It should be noted that for trona ore deposits located in Green River, Wyo., the temperature of such subterranean trona deposits typically is within the range of about 20° C. to about 30° C., and the temperature of alkali solutions recovered from solution mining of such deposits will likely be close to these temperatures.

By comparison, aqueous alkali solutions that are essentially equilibrated, saturated solutions (with respect to $NaHCO_3$ and $Na_2CO_3$) and that are obtained from the dissolution of sodium sesquicarbonate in trona ore using an aqueous medium such as water at 20° C. in a laboratory environment will contain about 17 wt. % $Na_2CO_3$ and about 4 wt. % $NaHCO_3$, corresponding to a total alkali content of about 19.5 wt. % total alkali. Small differences in the dissolution solvent temperatures will not significantly change the composition; e.g., the corresponding equilibrated, saturated alkali solution at 30° C. (vs. 20° C. just noted above) will contain about 17 wt. % $Na_2CO_3$ and about 4.7 wt. % $NaHCO_3$, corresponding to a total alkali content of about 20 wt. % total alkali.

For alkali minerals containing sodium carbonate and/or sodium bicarbonate, such as trona or nahcolite, the saturation concentration of an aqueous alkali mining solvent, or corresponding recovered mining solution, may be determined with reference to the total alkali content of the solvent or solution, which is measured as the total of sodium carbonate concentration and sodium bicarbonate concentration, expressed as equivalent sodium carbonate.

The aqueous alkali mining solvents employed in the present invention for solution mining of $NaHCO_3$-containing mineral ores such as trona and nahcolite contain substantially less-than-saturated concentrations of total alkali (sodium carbonate and sodium bicarbonate, as equivalent sodium carbonate), when these components are initially present in the aqueous mining solvent, and preferably contain less than about 12 wt. % total alkali, more preferably less than about 10 wt. % total alkali and most preferably less than about 5 wt. % total alkali, since lower initial total alkali contents in the mining solvent increase the efficiency of mineral ore recovery in the recovered mining solution, per unit volume of solvent employed.

The total alkali (T.A.) content of an aqueous alkali solvent or corresponding recovered mining solution refers to the total weight percent in an alkali solution of dissolved sodium carbonate and sodium bicarbonate, the sodium bicarbonate being expressed as its equivalent sodium carbonate content: Percent total alkali (T.A. wt. %) $Na_2CO_3$ (wt. %)+[53/84]× [$NaHCO_3$ (wt. %)]. For example, an aqueous alkali solution containing 13 wt. % $Na_2CO_3$ and 4 wt. % $NaHCO_3$ would have a total alkali content of 15.5 wt. % $Na_2CO_3$, since 4 wt. % $NaHCO_3$ corresponds to 2.5 wt. % equivalent $Na_2CO_3$, the conversion factor for the sodium bicarbonate content being [(½)×106 mol. wt. $Na_2CO_3$/84 mol. wt. $NaHCO_3$]. Concerning total alkali, it should be noted that solubillized salts other than carbonate and bicarbonate, e.g. sodium sulfate and other sulfur salts, are not considered to be components that contribute to the "total alkali" content of an aqueous alkali solution.

It should be recognized that solubilization of sodium bicarbonate, e.g., nahcolite, in an aqueous medium, e.g., a mining solution, typically results in a recovered mining solution that contains not only bicarbonate ($HCO_3^-$) but also some carbonate ($CO_3^{-2}$), particularly at alkaline pH values. Thus, aqueous alkali solutions obtained from dissolution of $NaHCO_3$-containing mineral ores normally contain both sodium bicarbonate and sodium carbonate.

The temperature of the mining solvent typically may vary over a wide range. Mining solvent temperatures may be as low as about 0° C./32° F., e.g., where water is used as the mining solvent and is obtained from natural sources like rivers or lakes in winter time, and may be as high as 50° C./122° F. to about 90° C./194° F., e.g., where the mining solvent is heated prior to injection into the region of the mineral ore being solution mined. The mining solvent temperature is preferably in the range of about 10° C./50° F. to about 40° C./104° F. and is more preferably in the range of about 15° C./59° F. to about 30° C./86° F.

Solution Mined Region

The region of the mineral ore bed or deposit to be solution mined may be a targeted area that is first prepared for solution mining, e.g., by fracturing using high pressure aqueous fluid or using explosives introduced via the connective borehole, to create additional surface area, e.g., fissures, cracks or voids, within the ore deposit or bed available for dissolution by direct contact with the solution mining solvent. Increasing the available surface area in the mineral ore to be solution mined increases the likelihood that the resultant mining solution will initially contain a high concentration of solubilized mineral ore values and that such high concentrations will be sustained in the mining solution for a significant length of time during the solution mining operation.

The solution mined region of the mineral ore bed may also include a length or portion of the drilled borehole within the mineral ore bed. The solution mined region, e.g., a solution mining cavity, may also or alternatively be formed by the dissolving action of the aqueous mining solvent along the length or portion of the drilled borehole within the mineral ore deposit or bed that is uncased and that is exposed to the solution mining solvent that is introduced through the initial part of the borehole into the uncased region, portion or length of the deposit or bed.

By way of illustration, the aqueous mining solvent may be introduced into the region of the solution-mined deposit or bed via a pipeline string having an outside diameter that is smaller than the bore diameter and that is located concentrically within the borehole, with the pipeline exit being located at a point distal along the borehole length and within the region to be solution mined. The mining solvent may then travel in a reverse direction along the length of the borehole and effect dissolution of the soluble components in the exposed mineral ore deposit or bed along the uncased length of the borehole.

The borehole distance that the mining solvent is exposed to the mineral ore deposit or bed to effect solubilization may be relatively short, e.g., a few tens or hundreds of feet or may extend for a thousand or multiple thousands of feet, before the mining solvent (now the resultant mining solution containing solubilized ore components) reaches the cased portion of the borehole or the borehole portion that passes through the insoluble layer, prior to such mining solution being withdrawn from the borehole at a point proximate to the borehole entry point.

Recovered Mining Solution

The mining solution that is recovered or withdrawn from the cavity formed in the region of the target mineral ore bed being solution mined may be collected in the vicinity of the mechanically-worked mining operation and then pumped to the surface for further processing. The collection point or means for temporarily holding the recovered mining solution, which is then pumped to the surface, may comprise one or more conventional holding tanks, a collection sump pit, a watertight closed chamber in the mine, or other typical mining solution collection or fluid holding means.

It should be apparent that the handling of the aqueous mining solvent introduced to the region of the targeted mineral ore bed as well as of the recovered aqueous mining solution presents no particular technological challenge to those skilled in the mineral ore mining art, despite the fact that these fluid transport and collection activities are carried out proximate to the underground mechanically-worked ore mining operation. Conventional underground dry mining operations routinely handle large quantities of water and alkaline solutions, e.g., for mining dust suppression, mining equipment washing and cooling, mining waste water, and the like, and these aqueous fluids are typically recovered and recycled or pumped out of the mine.

Other Solution Mining Operational Techniques

The practice of the solution mining method of this invention may involve many horizontally-oriented borehole configurations and solution mining liquor handling techniques, to provide for enhanced solution mining recovery efficiencies, and these will be readily apparent to those skilled in the solution mining art. For example, some of the techniques described in U.S. Pat. No. 5,690,390 of Bithell (FMC) can be adapted to the solution mining method of this invention. For this reason, the disclosures of U.S. Pat. No. 5,690,390 of Bithell (FMC) relating to the operation of the completed wells, the various horizontal borehole configurations, solution mining liquor collection and solution handling schemes are hereby incorporated by reference into this specification.

Optional Waste Tailings Disposal

The present invention may be utilized in the solution mining of trona or other $NaHCO_3$-containing subterranean ore deposits and optionally coupled with the disposal of waste tailings generated from operation of a soda ash or sodium bicarbonate production facility.

In both the "Sesquicarbonate Process" and "Monohydrate Process" for recovery of soda ash from trona ore, substantial amounts of insolubles remain undissolved after solubilization of raw and calcined trona ore in. these respective processes. The separation of these ore insolubles normally takes place in a clarifier and/or thickener where the insolubles settle to the bottom as muds, leaving a clarified aqueous solution of solubilized alkali values which are then processed downstream for crystallization of their alkali values, e.g., as sodium carbonate monohydrate or sodium sesquicarbonate. The muds, often called tailings or waste tailings, are concentrated high-solids slurries that are typically impounded in a contained surface pond.

Disposal of such waste tailings has been described in conjunction with solution mining operations by Frint et al. in U.S. Pat. Nos. 5,043,149 and 5,192,164, which describe slurrying the waste tailings in an alkaline solution and then introducing the tailings-containing slurry into a subterranean solution mining cavity or mined-out area for disposal. The tailings settle out, and the alkaline solution, enriched (if initially unsaturated) from dissolution of the subterranean ore values, may then be withdrawn to the surface for recovery of the alkali values, e.g., as soda ash.

The disclosures of U.S. Pat. Nos. 5,043,149 and 5,192,164 of Frint et al. are hereby incorporated by reference for their teachings of the use of unsaturated alkali solutions for disposal of waste tailings in subterranean solution mining cavities and the recovery of substantially saturated mining solutions from such subterranean disposal cavity sites.

The present invention may be utilized in the solution mining of trona or other $NaHCO_3$-containing subterranean ore deposits in combination with the waste tailings disposal procedures of U.S. Pat. Nos. 5,043,149 and 5,192,164 of Frint et al., such that the aqueous mining solvent employed in the method of this invention also contains waste tailings intended for disposal in the solution mining cavity.

The following non-limiting Example illustrates a preferred embodiment of the present invention.

Example

Figure 2:
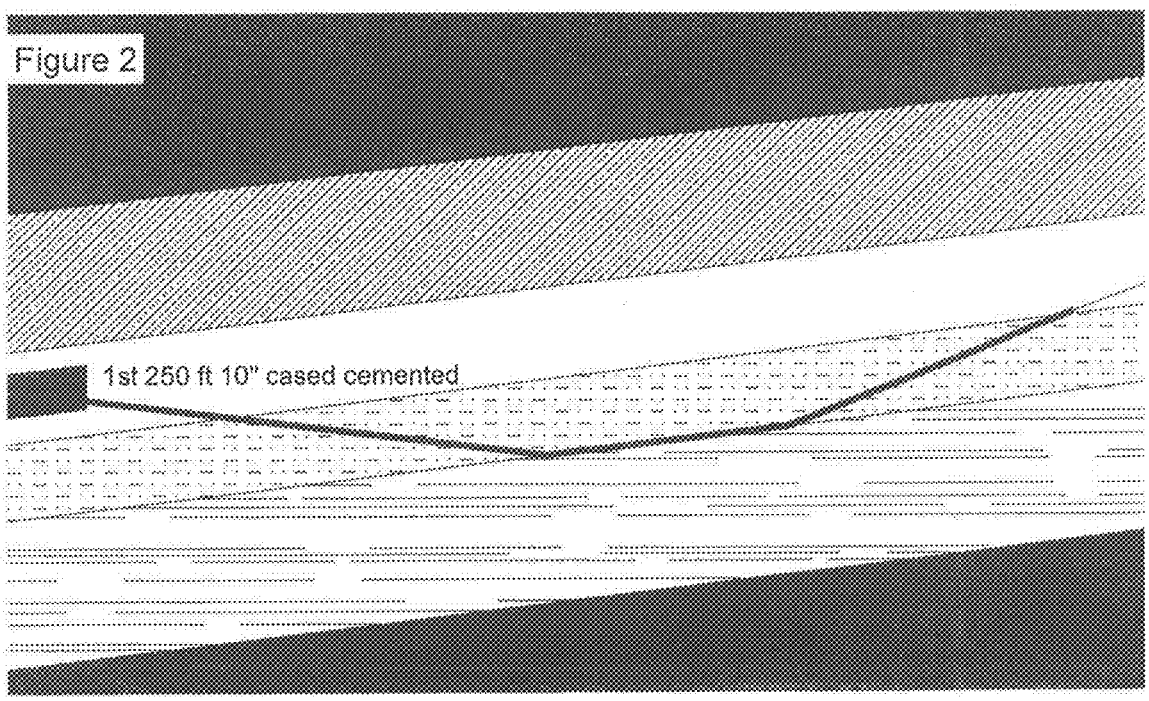
FIG. 2 is a schematic drawing of the solution mining method of this invention applied to recovery of trona ore, showing an expanded view of side cross-section of FIG. 1, that depicts the route of the drilled borehole, extending from the trona deposit face in the chamber in a mechanically-mined trona operation into the underlying shale layer and then its return into the trona layer toward the trona region to be solution mined.

The Example describes a solution mining operation that utilizes the process of the present invention, in the solution mining recovery of a subterranean trona ore deposit, and reference is made to the drawings in FIGS. 1 and 2.

The subterranean trona deposit is a horizontally-lying bed of trona ore, about 10 feet in thickness located in the Green River formation near Green River, Wyo., at a depth of about 1500 feet below the earth's surface. The trona ore has a Mohs hardness of 3.2 and a compressive strength of about 3500 psi, as depicted in FIG. 1; its in situ stress is about 1600 psi. It should be recognized that, depending on the location of the trona ore bed sampling point for the widespread trona ore bed in the Green River formation, the Mohs hardness and compressive strength measurements may vary, e.g., within a range of 2.5-3.2 for Molls hardness and 3500-7000 psi for compressive strength.

The trona ore deposit is presently mined via conventional mechanical mining procedures, but the ore bed is so extensive that large portions of the bed adjacent to the mining operations have not been mined or otherwise worked and are suitable for solution mining via the process of this invention, as follows.

The trona ore bed is overlaid and underlaid by adjacent thick shale layers. The shale layer underlying the trona ore bed is characterized by having two zones, with the shale immediately adjacent to the trona (the first shale layer) being about 2-8 feet in thickness, having a Mohs hardness of 4 and a compressive strength of 1500-2500 psi, and the next shale layer below the first (i.e., the second shale layer) being about 20 feet in thickness, having a Mohs hardness of 4 and a compressive strength of about 1000-2000 psi, as depicted in FIG. 1.

A subterranean solution mining operation is developed utilizing the operating portions of the existing mechanical mining operation being worked to recover trona ore from the horizontally-lying deposit, located about 1500 feet below the surface. The existing trona mechanical mining operation comprises vertical mine shafts, connecting the surface operations with the subterranean mechanical mining operations, that provide access to and service the underground mining operation, including personnel and equipment access (via mine cage hoists), ore removal (skips) and ventilation (air intake and exhaust) and utilities (electrical, communications and water lines). The mining operation also comprises, at the bed level, horizontal workings off the vertical mining shafts that include ingress and egress passageways, drifts, rooms and other connective passageways that provide access for mining trona ore panels via conventional longwall mining or continuous mining or room and pillar mining.

The trona ore deposit to be solution mined is located in the same horizontally-oriented trona ore bed being worked in the mechanically-mined operation, and the region to be solution mined is separated by several hundred feet of unmined trona deposit from the region of the mine being mechanically mined.

A drilling apparatus is partially dissembled on the surface, transported from the surface via a hoist in a mineshaft and reassembled in a subterranean room ("solution mining work room") connected to the operational trona mine. The solution mining work room utilized for the drilling apparatus and drilling platform is situated near a trona ore mine face on the perimeter of the subterranean worked mine so as to provide drilling access to unworked trona in the trona deposit without the drilled borehole passing through or proximate to any worked portion of the operational mechanically-worked mine.

Directional drilling is carried out using the drilling apparatus situated in the solution mining work room adjacent to the operational mine, using a drilling assembly that includes a measurement-while-drilling (MWD) tool bit to facilitate steered drilling of the borehole in a controlled direction using electronic and mechanical feedback data from the drill bit assembly.

The drilled borehole is directionally-controlled to pass downwards, from the trona ore bed drilling initiation point, such that the borehole deviates downwards and exits the trona ore bed and enters the underlying shale layers. The borehole is drilled into the shale layer for a distance of about 250 feet in the shale layer, in a direction that is substantially parallel to the interface (boundary) between the trona ore layer and shale layer, being at a distance of at least about 6-8 feet from the trona-shale interface, as shown in FIGS. 1 and 2.

The drilling of the borehole, within the 250 feet of drilled distance in the shale layer, is then directionally deviated to return to the trona ore layer at a point about 250 feet from the drilling initiation point, as shown in FIG. 2. Drilling is then continued within the updip trona ore bed, until the total drilled distance is about 4250 feet from the drilling initiation point. The location of the end of the drilled borehole, at the point distal from the initiation point, is about 15 feet higher in elevation (closer to the surface) than the initiation point of the borehole. This elevation difference is sufficient to facilitate gravity-induced return flow of the introduced mining fluid and resultant mining solution from the distal end back to the initiation point of the borehole.

The borehole is initially drilled using a drill bit that provides a 4 inch diameter bore but this is subsequently reamed out to provide an 8 inch bore for the borehole for the length of the 4250 foot hole. In addition, the first 250 feet of the drilled borehole is reamed further to a diameter of 12 inches for installation of 10-inch diameter casing from the drilling initiation point. The installed casing is then cemented.

For introduction of the mining solvent, a tubing string having a diameter of 4 inches is installed in the entire length of the drilled, reamed borehole, ending slightly short of the terminus end of the borehole, to provide a conduit, i.e., injection pipeline, for the mining solvent that is pumped to the distal end of the pipeline string.

After drilling and reaming of the borehole are completed and the injection pipeline is installed and tested, the drilling rig and its associated equipment may be removed or relocated.

Solution mining is carried out by introducing a mining solvent that is pumped through the 4-inch injection pipeline to the distal end of the injection pipeline, where it exits into the drilled borehole. The mining solvent is then allowed to flow in the reverse direction in contact with the exposed trona deposit on the wall surfaces of the drilled borehole along the length of the drilled borehole (beyond the initial 250 feet of cased borehole). The mining solvent effects dissolution of the soluble components of the trona, e.g., sodium sesquicarbonate, and forms a mining solution containing sodium carbonate and sodium bicarbonate dissolved from the trona. The mining solution that flows coaxially along the length of the drilled borehole (in a direction opposite to the incoming mining solvent flow in the injection pipe) is withdrawn at the initiation point of the borehole.

The injection pipeline used for introduction of the mining solvent is connected at the initiation point of the drilled borehole to additional pipeline that provides a conduit for mining solvent supplied from the surface. This additional string of injection pipeline extends through existing mine passageways and then to the surface via a vertically-disposed pipeline in one of the existing utility mine shafts used for the mechanically-worked trona mining operation, to the supply-source of aqueous mining solvent on the surface.

The aqueous alkaline mining solvent is river water, available at the surface near an existing soda ash facility. The river water is decanted to remove suspended solids. Its temperature varies seasonally but is about is between about 5° C./41° F. in winter to about 20° C./68° F. in summer. The river water employed as mining solvent contains no dissolved sodium carbonate or sodium bicarbonate, i.e., its total alkali value is essentially zero.

The aqueous alkaline mining solvent is introduced into contact with the trona ore along the wall surfaces of the drilled borehole via being pumped through the injection pipeline at a flow rate of 200 gallons/minute. The residence time of the aqueous mining solvent in contact with the trona ore along the 4000 feet of drilled borehole increases as the borehole is enlarged by dissolution of the soluble components of the trona ore, but is initially about ¾ hour and would be about 3¼ hours when the borehole diameter is increased by dissolution of soluble ore components from its initial 8 inches to an average of 16 inches.

The mining solution formed from contact of the aqueous mining solvent with the trona at the exposed wall surfaces along the drilled borehole is withdrawn from the borehole at the initiation point of the drilled borehole, for collection and pumping to the surface for recovery of its solubilized alkali values. The resultant aqueous alkaline mining solution that is withdrawn from the borehole has a significantly increased total alkali content, containing about 11 wt. % sodium carbonate and about 4 wt. % sodium bicarbonate, representing a total alkali content of about 13.5 wt. %.

The aqueous alkaline mining solution that is withdrawn at the initiation point of the borehole is collected in a sump chamber or pit that serves as a collection point, located near the withdrawal end or the borehole, in the operational mechanically-worked mine. The withdrawn alkaline mining solution in the sump chamber is pumped to the surface, via a pipeline to be used for mining solution transport (separate from the aqueous mining solvent pipeline connected to the injection pipeline string used for aqueous mining solvent transport and injection) that is installed in passageways leading to an existing utility mine shafts used for the mechanically-worked trona mining operation.

The withdrawn aqueous alkaline mining solution that is pumped to the surface is then processed in a soda ash facility located on the surface to recover the solubilized alkali values in the aqueous mining solution, via crystallization of a sodium carbonate species like sodium carbonate monohydrate.

It will be appreciated by those skilled in the art that changes could be made to the embodiments described above without departing from the broad inventive concept thereof. It is understood, therefore, that this invention is not limited to the particular embodiments disclosed but is intended to cover modifications within the spirit and scope of the present invention as defined by the appended claims.

What is claimed is:

1. A method of solution mining a subterranean mineral ore deposit comprising connecting (i) an existing subterranean mechanically-worked mineral ore mining operation and (ii) a mineral ore bed region to be solution mined, wherein mineral ore values of both the existing subterranean mechanically-worked ore mining operation and the mineral ore bed region to be solution mined is a soluble material, with a borehole drilled into the mineral ore bed region to be solution mined using subterranean drilling apparatus located proximate to the existing subterranean mechanically-worked mineral ore mining operation;

isolating the mineral ore bed region to be solution mined from the existing subterranean mechanically-worked mineral ore mining operation by passage of the drilled borehole from the existing subterranean mechanically-worked mineral ore mining operation through an insoluble impermeable layer adjacent to the mineral ore bed to be solution mined and then into the mineral ore bed region having soluble solution mineral ore values to be solution mined to form an isolated mineral ore bed region so that mining solution is prevented from flowing back into the existing subterranean mechanically-worked mineral ore mining operation;

solution mining the isolated mineral ore bed region using a mining solvent introduced into the mineral ore bed region to be solution mined to solubilize the mineral and form a mining solution; and withdrawing mining solution from the solution-mined mineral ore bed region.

2. The method of claim 1 wherein the subterranean mineral ore comprises a mineral solubilizable in a mining solvent selected from the group consisting of water, aqueous alkali solutions and aqueous acid solutions.

3. The method of claim 1 wherein the subterranean mineral ore to be solution mined comprises a mineral selected from the group consisting of trona, wegscheiderite, nahcolite and mixtures of these minerals.

4. The method of claim 3 wherein the mining solvent is selected from the group consisting of water and aqueous alkali solutions.

5. The method of claim 1 wherein the subterranean mineral ore to be solution mined comprises a mineral selected from the group consisting of potash, halite, uranium, copper and gold.

6. The method of claim 1 wherein the impermeable layer comprises shale.

7. The method of claim 1 wherein the drilled borehole, connecting the mineral ore bed region to be solution mined and the mechanically-worked mineral ore mining operation, (i) is initiated into the mineral ore bed proximate to the mechanically-worked mineral ore mining operation, (ii) is directed out of the mineral ore bed into the adjacent impermeable layer, and (iii) is then directed into the mineral ore bed region to be solution mined.

8. The method of claim 1 wherein the drilled borehole, connecting the mineral ore bed to be solution mined and the mechanically-worked mineral ore mining operation, (i) is initiated directly into the impermeable layer proximate to the mechanically-worked mineral ore mining operation and (ii) is then directed into the mineral ore bed region to be solution mined.

9. The method of claim 1 wherein the drilled borehole passing through the impermeable layer and connecting the mineral ore bed region to be solution mined and the mechanically-worked mineral ore mining operation is at least 50 feet in length in the portion of drilled borehole passing through the impermeable layer.

10. The method of claim 1 wherein the mineral ore bed region to be solution mined is located at least 200 feet from the initiation point of the drilled borehole in the mechanically-worked mineral ore mining operation.

11. The method of claim 1 wherein the drilled borehole is cased in at least a portion of the drilled borehole extending from the drilling initiation point.

12. The method of claim 1 wherein the drilled borehole is cased from the initiation point of the drilled borehole through the impermeable layer.

13. The method of claim 1 wherein the drilled borehole connecting the mechanically-worked mineral ore mining operation and the mineral ore region to be solution mined is updip from the mechanically-worked mineral ore mining operation.

14. The method of claim 1 wherein the subterranean mineral ore bed region to be solution mined is an abandoned section of a previously mechanically-worked mineral ore bed.

15. The method of claim 1 wherein injection of the mining solvent is carried out through the borehole.

16. The method of claim 1 wherein withdrawal of the mining solution is carried out through the borehole.

17. The method of claim 1 wherein the withdrawn mining solution is pumped to the surface for further processing.

18. The method of claim 1 wherein injection of the mining solvent is effected via a first drilled connective borehole and recovery of the mining solution from the solution-mined ore deposit is effected via a separately-drilled second connective borehole.

19. The method of claim 1 which further comprises injecting of the mining solvent via at least one injection well drilled from the earth's surface into the region of mineral ore deposit to be solution mined and recovering the resultant mining solution from the solution-mined ore deposit via borehole.

* * * * *